United States Patent [19]

Braunschweiler

[11] 4,283,060

[45] Aug. 11, 1981

[54] TARGET HAVING LIMITED ROTATIONAL MOVEMENT UPON IMPACT

[76] Inventor: H. Georg Braunschweiler, Dahlienweg 1, 5223 Riniken, Switzerland

[21] Appl. No.: 71,944

[22] Filed: Sep. 4, 1979

[30] Foreign Application Priority Data

Sep. 13, 1978 [CH] Switzerland ..... 9573/78

[51] Int. Cl.[3] ..... F41J 5/00; F41J 7/00

[52] U.S. Cl. ..... 273/383; 273/386; 273/388; 273/392

[58] Field of Search ..... 273/378, 383, 386, 387, 273/388, 392, 406, 390

[56] References Cited

U.S. PATENT DOCUMENTS

| | | | |
|---|---|---|---|
| 1,212,943 | 1/1917 | Hart | 273/388 X |
| 1,424,632 | 8/1922 | Fenton | 273/392 |
| 2,706,634 | 4/1955 | Van Valkenburg | 273/406 |
| 2,738,978 | 3/1956 | Henry | 273/388 X |

FOREIGN PATENT DOCUMENTS

| | | | |
|---|---|---|---|
| 453673 | 9/1936 | United Kingdom | 273/388 |

*Primary Examiner*—Anton O. Oechsle
*Attorney, Agent, or Firm*—Werner W. Kleeman

[57] ABSTRACT

The combat target of the invention, in contrast to the prior art drop or fall targets, is capable of automatically indicating a number of target hits occurring time wise in succession, without there being necessary, after each hit, manual resetting of the target. For this purpose, the target image is rigidly coupled for rotation at a power take-off shaft of a force or power storage means, the power take-off shaft being essentially vertically disposed when the target is in its erect position. The storage capacity of the force storage means is adequate for accomplishing a number of revolutions of the power take-off shaft. A stop or impact arrangement, in its engaged or effectual position, prevents rotation of the power take-off shaft as long as there is no target hit, but upon occurrence of a target hit is temporarily brought out of such engaged or effective position.

10 Claims, 10 Drawing Figures

TARGET HAVING LIMITED ROTATIONAL MOVEMENT UPON IMPACT

BACKGROUND OF THE INVENTION

The present invention relates to a new and improved construction of a combat target which is of the type having a target image which is resiliently pre-biased against an impact or stop arrangement which, in turn, in the presence of a target hit at the target image can be brought into its ineffectual or disengaged position, and thus, releases the target image for rotation.

There are known to the art so-called drop targets, wherein the target image, generally structured as a head or chest target, is articulated at its lower edge at a stake or peg or the like or bears against a console or panel protruding from such stake. Additionally, extending from the stake or peg is a hook which piercingly extends with play through an opening provided at the target image. Engaging at the hook is a pivot lock which is hingedly connected at the side of the target image which faces away from the stake. At this pivot lock there engages a tension spring which strives to rock the pivot lock out of the hook, and thus, to release the arresting action exerted at the target image. At the stake there are also supported compression springs which strive to forwardly tilt the target image. Due to the action of the compression springs the pivot lock, after it has been rocked into the hook, remains fixedly clamped thereat and is prevented from rocking out of engagement with said hook. As soon as the target image is hit by a shot, then the compression springs, supported at the stake, temporarily are resiliently biased somewhat so that the pivot lock, under the action of its tension spring, can rock out of the hook, and therefore forwardly tilts over the target.

According to a second known drop target of the previously mentioned type the hook is articulated at the stake and is automatically suspended into the opening of the target image. At the target image there is articulated an impact arm with which there is operatively associated a tension spring. The impact arm, while stressing the tension spring, can be suspended at a projection of the target image. Upon jarring the target image, caused by a target hit, the impact arm travels over this projection, is rocked by its tension spring, and thus, strikes against the hook, rocks such hook, and therefore releases the target image so that it can perform a tilting movement. This second prior art drop target, in contrast to the heretofore discussed first embodiment of prior art drop target, has the advantage that the target image always tilts-over irrespective of whether the hit is at the one or other side of the target image.

What is common to both of the heretofore known state-of-the-art drop or fall targets is that, each hit, which sufficiently jars the target image, is directly displayed or indicated. However, in contrast to this advantage there prevails the much greater disadvantage that the once hit drop target which has thus fallen over, again must be manually erected. Therefore, with the heretofore known targets of the previously mentioned type, the hit display is a one time operation, requiring manual target resetting.

A training firing at a number of prior art targets therefore must be interrupted as soon as there have been obtained as many full hits as there have been erected targets. During this interruption the targets again can be erected.

Considering the fact that such combat targets, as a general rule, are erected in training terrain of poor accessability and, in part, the targets being erected at considerable distance from the gunners, each interruption of the target practice or firing operation, needed for again setting up the targets, constitutes an appreciable loss in training time.

SUMMARY OF THE INVENTION

Therefore, with the foregoing in mind, it is a primary object of the present invention to provide a new and improved construction of combat target or the like which is not afflicted with the aforementioned drawbacks and limitations of the prior art proposals.

Another and more specific object of the present invention aims at providing a new and improved construction of combat target of the previously mentioned type, which automatically allows for indicating a number of hits which occur time wise in succession.

Now in order to implement these and still further objects of the invention, which will become more readily apparent as the description proceeds, the target of the present development is manifested by the features that the target image is coupled rigidly for rotation at a power take-off shaft of a force or power storage means. The power take-off shaft extends in essentially upright fashion when the target is erected. The storage capacity of the force or power storage means is adequate for performing several revolutions of the power take-off shaft, and the impact or stop arrangement, in the presence of a hit, can be temporarily rendered ineffectual.

The rotation of the target, caused by a hit, in this case is not brought about by the force of gravity, rather by the force or power storage means, for instance by a spring motor, which at the same time also resiliently pre-biases the target image against the stop or impact arrangement.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
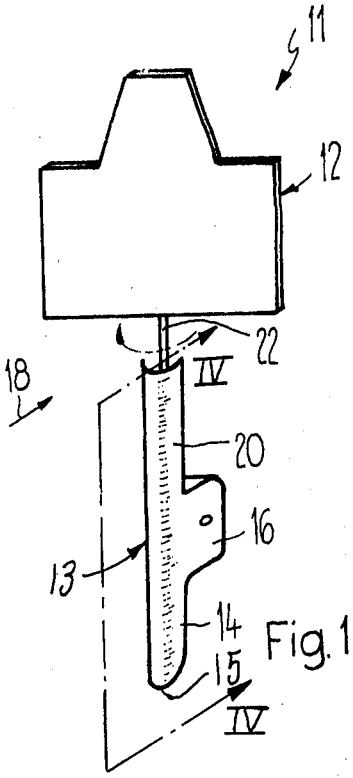
FIGS. 1, 2 and 3 are respective simplified, schematic illustrations of three different exemplary embodiments of combat targets or the like constructed according to the invention.

Describing now the drawings, initially there will be discussed, based upon the showing of FIGS. 1, 4 to 7 and 10, a first exemplary embodiment of combat target or the like, there being remarked, however, that with all of the exemplary embodiments disclosed herein there have generally conveniently been used the same reference characters to denote the same or analogous components as concerns their functional operation.

The exemplary illustrated combat target 11 will be seen to comprise a target image 12 and an anchoring portion or anchoring means 13. The lower part of the anchoring portion 13, formed of a bullet proof material, for instance steel, possesses a pointed end 15, so that the anchoring part 13 can be embedded into the terrain in the manner of a stake or peg or the like. In special cases, there can be provided instead of the pointed end 15 also a socket or base. At the anchoring part or anchoring means 13 there is formed, following the lower portion 14, a housing 16. This housing 16 serves for the reception of a force or power storage means 17, which, for instance, can be constituted by a battery-operated transmission motor or, as in the case of the described embodiments, a spring motor. As best seen by referring to FIG. 5, the housing 16 possesses at its side, confronting the firing direction (arrow 18) a greater wall thickness than the remaining part of the housing 16.

Figure 4:
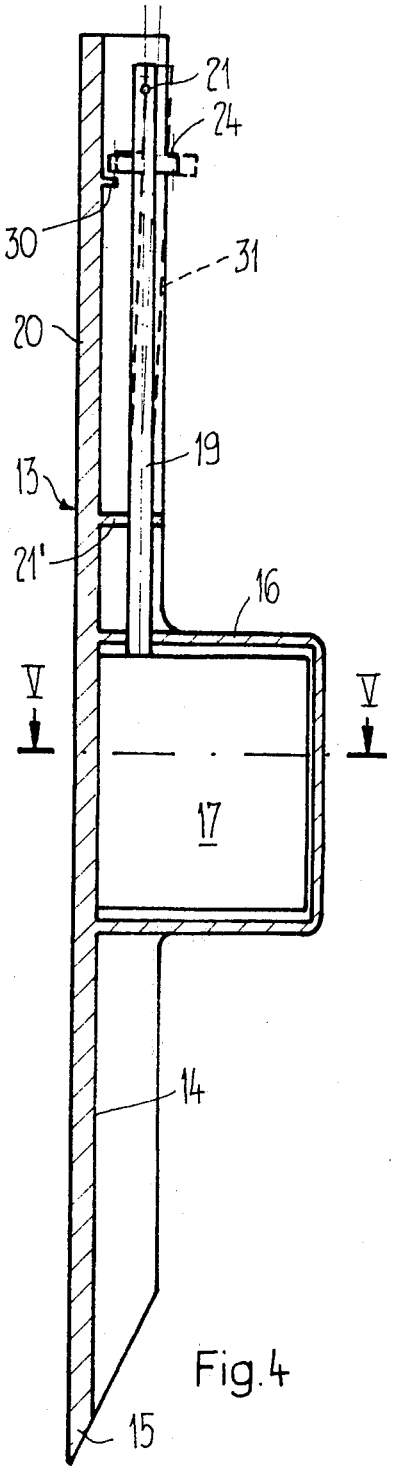
FIG. 4 is a sectional view along the line IV—IV of FIG. 1.
Figure 6:
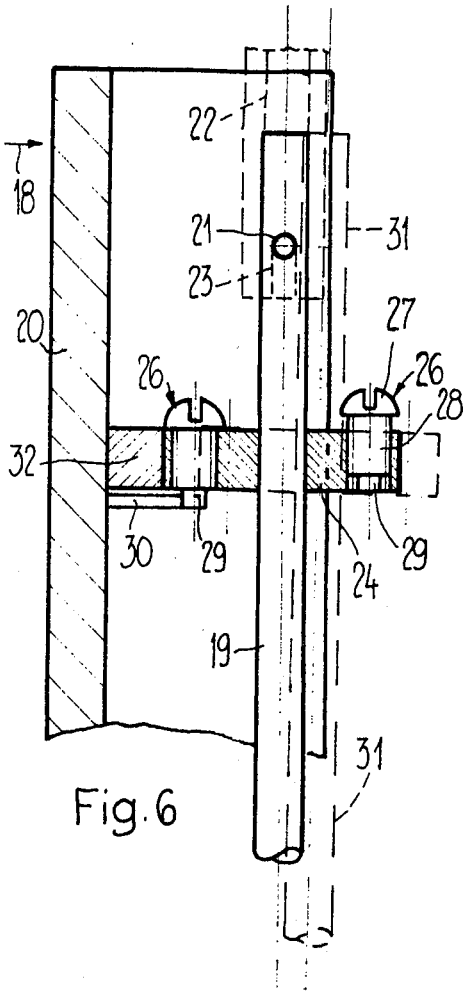
FIG. 6 shows in enlarged scale the upper part of the sectional view of FIG. 4, portraying details of the stop or impact arrangement.
Figure 5:
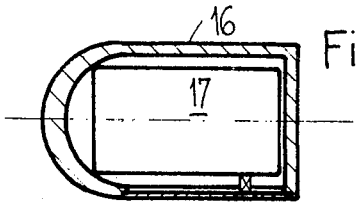
FIG. 5 is a sectional view along the line V—V of FIG. 4.

With the embodiment shown in FIGS. 1, 4 and 6, the force or power storage means 17 will be seen to comprise a power take-off shaft 19 extending upwardly out of the housing 16. With this embodiment, for the purpose of protecting the power take-off shaft 19 from being fired upon, the anchoring part 13 additionally will be seen to contain an upwardly extending protective rail 20 or the like, which merges with the housing 16, has in section an approximately U-shaped configuration and surrounds the power take-off shaft 19.

The power take-off shaft 19, structured so as to be flexurally elastic, is rotatably mounted, at the region of the housing 16, in a bearing cantilever or support arrangement 21' formed at the protective rail 20.

At the upper end of the power take-off shaft 19, there is inserted a pin 21 which piercingly extends transversely through the power take-off shaft 19 and radially protrudes therefrom at both sides. On the other hand, the target image 12 is attached to a tubular element or section 22 having at its free end a slot 23 or the like, as the same has been shown in phantom lines in FIG. 6. Hence, the tubular element 22 can be mounted on the power take-off shaft 19, and thus, the target image 12 is rigidly connected for rotation with the power take-off shaft 19.

Figure 7:
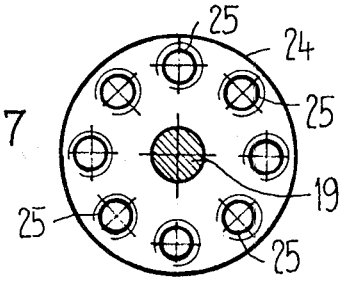
FIG. 7 is a top plan view of an impact or stop support.

A disk-shaped impact or arresting support 24 is rigidly connected for rotation with the power take-off shaft 19 at the upper region of such power take-off shaft 19. This impact or arresting support 24 will be seen to possess a rim of threaded bores 25, extending transversely therethrough, in the embodiment under discussion there being shown eight such threaded bores 25 at an angular spacing from one another of about 45° (FIG. 7).

Threaded into such threaded bores 25 are the impact or stop screws 26 or equivalent arresting devices, which, in turn, possess a slotted head 27, a threaded shaft 28 and, at their related free end, an impact or arresting plug or pin 29 or the like. As best seen by referring to FIG. 6, the impact or stop plug 29 or the like, depending upon the depth of screwing-in of the impact or stop screw 26, either protrudes out of the bore 25 or, however, remains inset therein.

At the protective rail 20, there is anchored an impact or stop pin member 30 extending radially with respect to the power take-off shaft 19 and pointing in the direction thereof. This impact or stop pin member 30 coacts with the stop plug or plugs 29 to the extent that such stop plugs 29 extend out of the bores 25 of the impact or arresting support 24. Thus, the impact or stop pin 30 prevents the power take-off shaft 19 from performing a rotation as soon as an impact or arresting plug 29 abuts against the impact or stop pin 30.

Now if a hit occurs at the target image 12, then the power take-off shaft 19, owing to its flexural or bending elasticity, momentarily bends to such an extent that the previously effective impact or arresting plug or pin 29 comes out of engagement with the impact or arresting pin member 30. This has been indicated in FIGS. 4 and 6 by means of the broken contour lines 31. Now the force or power storage means 16 is free to rotate its power take-off shaft 19, and thus, the target image 12 until a next impact or arresting plug or pin 29 contacts against the impact pin member 30, and thus, the power take-off shaft 19 is again caused to stop its rotation.

Consequently, it will be seen that if in the stop or arresting support 24 there is only completely screwed-in a single impact or arresting screw 26, then the target image 12 carries out rotation through 360° for each target hit. On the other hand, if there are completely screwed-in a respective impact or arresting screw 26 at two diametrically opposite bores 25, then for each hit there is brought about 180°-rotation of the target image 12. With four arresting screws 26, threaded-in at a spacing of 90° from one another, there is realized a 90°-rotation. In conjunction with FIG. 3 there will again be reverted to this particular embodiment.

In order not to place out of engagement, i.e. render ineffectual the pair of impact elements 29, 30 by other influences (e.g. wind pressure exerted at the target image 12) than a target hit at the target image 12, it is possible to secure a permanent magnet 32 at the inner side or face of the protective rail 20. This permanent magnet engages in a flat manner at the circumference of the impact or stop support 24 and retains the power take-off shaft 19 in its non-bent rest position throughout such time that there is not present any target hit.

Figure 10:
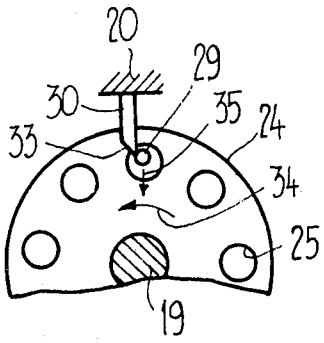
FIG. 10 is a simplified view, looking in the direction of the power take-off shaft of an embodiment of stop or impact arrangement which can be temporarily brought out of engagement or into its ineffectual position.

Since the bending through of the power take-off shaft 19 caused by a target hit, can recover very rapidly under circumstances, depending upon the inertia of the target image 12, and the target image during this time possibly only will have carried out a fraction of the contemplated rotational movement, it is possible, as shown in FIG. 10, to provide the stop or impact pin member with a deflecting surface 33. In this connection there will be mentioned a still further detail. The force or power storage means 17, exerts upon the power take-off shaft 19, hindered from rotating by the stop or arresting pair 29, 30 a pre-biased moment in the direction of the arrow 34. This pre-biased moment causes the power take-off shaft 19, in its arrested rest position, to laterally bend out somewhat owing to its bending elasticity, in other words, in FIG. 10 to bend towards the right. As soon as a hit at the target has been accomplished and the power take-off shaft 19 has been deflected in the direction of the arrow 35, then the aforementioned lateral bending-out no longer is present, and when the deflection, caused by the target hit, no longer is present, then the previously effective impact or arresting plug or pin 29 will with certainty have moved past the pin member 30.

Figure 2:
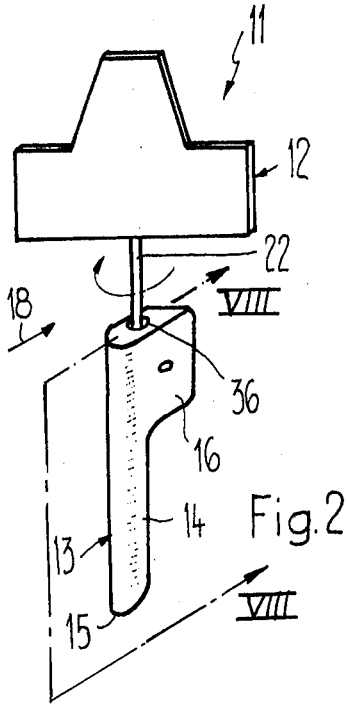
Figure 8:
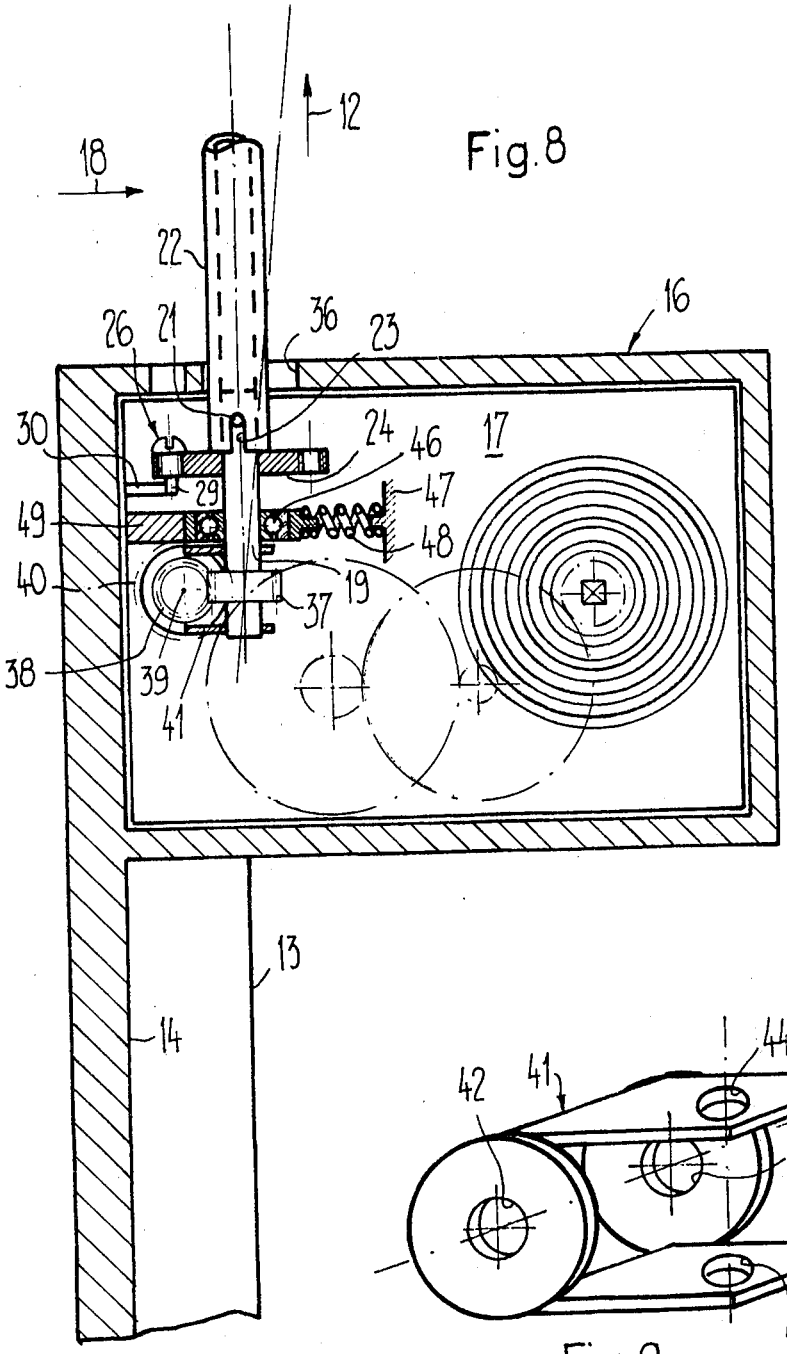
FIG. 8 is a sectional view of the arrangement of FIG. 2, taken substantially along the line VIII—VIII thereof.
Figure 9:
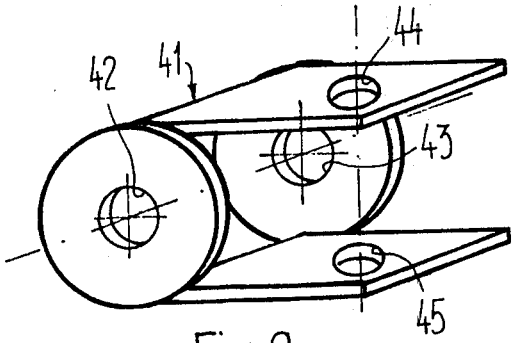
FIG. 9 is a perspective view of part of the embodiment of FIG. 8.

The appreciable difference between the embodiment of FIGS. 1, 4 and 6 and that of FIGS. 2 and 8 resides in the fact that the power take-off shaft 19 (FIG. 8) does not extend out of the housing 16. So that the tubular element 22 of the target image 12 can be connected by the pin 21 to the power take-off shaft 19, an elongate hole 36 is formed at the housing 16. A worm gearing 37, which meshes with a worm 38, is seated upon the power take-off shaft 19 which, owing to its small length, is hardly flexurally elastic. The worm gearing or gear 37 and the worm 38 thus form the last gearing stage of the force or power storage means 17. Seated upon the shaft 39 of the worm 38 is a gear which drives this worm 38 and, additionally, there is hingedly connected with the shaft 39 a bearing bracket 41. The bearing bracket 41, shown schematically and in perspective view in FIG. 9, will be seen to comprise a first pair of coaxial bores 42, 43, with which there is hingedly connected the bearing bracket 41 at the shaft 39 of the worm 38. Furthermore, the bearing bracket 41 possesses a second pair of coaxial bores 44, 45 serving to mount the power take-off shaft 19 to both sides of the worm gear 37. It will be recognized that by virtue of the foregoing construction the power take-off shaft 19 is tiltable about the shaft or axle of the worm 38, without the worm gear 37 coming out of engagement with the worm 38.

Furthermore, there is seated upon the shaft 19 a ball bearing 46, at the circumference of which there engages one end of a compression or pressure spring 48 which is stationarily supported at its other end, as indicated at location 47. This compression spring 48 presses the ball bearing 46 against a stop 49 which, for instance, can be formed by a permanent magnet, and thus, retains the power take-off shaft 19 in its non-tilted erect rest position. Just as was the case for the preceding exemplary embodiments, in this rest position the coaction of the stop or impact pin member 30, anchored at the housing 16, with the stop or impact plugs or pins 29 at the stop support 24, prevents rotation of the power take-off shaft 19, and thus, the target image 12. However, as soon as a hit occurs at the target image 12, then the power take-off shaft 19 briefly tilts against the action of the spring 48, about the shaft or axle 39 and the stop pair 29, 30 comes out of engagement with one another, with the result that there is nothing which any longer precludes the rotation of the power take-off shaft 19 and thus the target image 12.

In order to also be able to ensure, with this embodiment, notwithstanding the faulty bending elasticity of the power take-off shaft 19 that the rotation of the target image 12 can then occur in response to a target hit, even if the resilient action of the compression or pressure spring 48 is restored very rapidly, the impact or stop pin member 30 can be arranged to be pivotable in the housing 16, through a small angular value and against the action of a weak stop or impact spring (not shown). Upon contact of a stop plug or pin 29 at the pin member 30, such initially yields in accordance with its pivotal range, and then first causes the power take-off shaft 19, which is at a pre-bias moment, to be brought to a standstill. In the presence of a target hit, the impact or stop pair 29, 30 is temporarily brought out of engagement and, during this time, the impact pin member 30 springs back, so that during the restoration of the spring action of the compression spring 48, the impact or stop pin 29 which previously was in engagement, is positively caused to move "past" the impact or stop pin member 30.

It should be understood that the storage capacity of the force storage means 17, though adequate for a number of revolutions of the power take-off shaft 19, is limited. On the other hand, it should be evident why it is strived with a "charge" of the force or power storage means 17, to indicate as many time wise successive hits. Now if, for instance, the capacity of the force or power storage means 17 is adequate for four complete revolutions of the power take-off shaft 19, then it is possible to indicate with the heretofore described embodiments four hits if only one impact or stop screw 26 has been screwed into the stop or impact support 24. On the other hand, there can be indicated eight hits if, as already mentioned, two screws 26 are screwed-in at diametrically opposite locations of the impact carrier or support 24.

Figure 3:
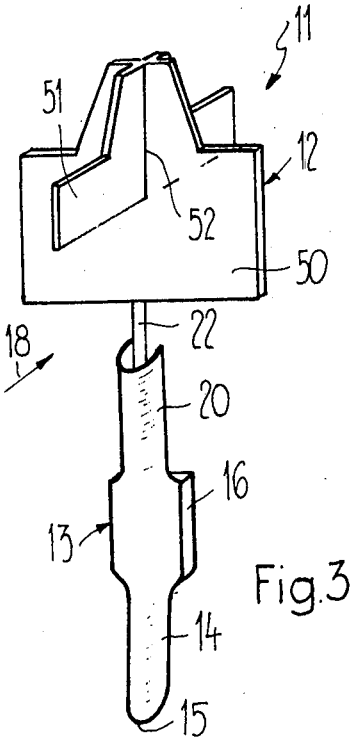

A further increase of the number of hit indications which are possible with a "charge" of the force storage means 17, is afforded by the embodiment of FIG. 3. With this embodiment the target image 12 has two target surfaces 50, 51 which are dispositioned at right angles with respect to one another, these target surfaces 50, 51 differing from one another in their format and/or in their color and/or in their shape. Both of the target surfaces 50 and 51 intersect along an intersection line 52, preferably coinciding with the axis of the tubular element 22 and the power take-off shaft 19. Now if with the embodiment of FIG. 3 there are threaded into the impact or stop carrier four impact or stop screws 26 at an angular spacing of 90° from one another, then with the heretofore made assumption, the embodiment of FIG. 3 affords the possibility of indicating sixteen successive hits.

A further advantage of this embodiment, insofar as it possesses two target surfaces which differ especially in format from one another, resides in the fact that it is possible to carry out at one and the same combat targets a so-called "program firing". After a hit, which can be made more easily, at the larget target surface, there appears for the gunner, at the next target surface, automatically the smaller target surface which is of greater difficulty to hit.

The possibly larger weight of the anchoring part 13 of the described combat target, in comparison to the stake of the heretofore known drop target, is more or less compensated by the multiply increased hit-display or indicator capacity. Hence, it is possible in any event to indicate appreciably more target hits with less combat targets of the described type, than is possible with a larger number of known drop targets. Instead of the impact carrier or support 24 with the impact screws 26 threaded therein, there can be also used as the impact element a toothed wheel or a ratchet which coacts with a stationarily mounted tooth.

While there are shown and described present preferred embodiments of the invention, it is to be distinctly understood that the invention is not limited thereto, but may be otherwise variously embodied and practised within the scope of the following claims. ACCORDINGLY,

What I claim is:

1. A combat target comprising:

means defining a target image;

a force storage means including a power-take off shaft;

said power-take off shaft being essentially erect when the target image is erect;

said target image being coupled for common rotation with said power-take off shaft;

the storage capacity of the force storage means being adapted for performing a number of revolutions of the power take-off shaft;

a stop arrangement against which said take-off shaft is resiliently biased;

said stop arrangement in the presence of a hit at the target image being temporarily placed into an ineffectual position for allowing the target image to perform a limited rotational movement;

said stop arrangement includes at least one first stop which is rigidly connected for rotation with the power take-off shaft;

said stop arrangement further including a stationarily arranged second stop coacting with said first-mentioned stop;

both of said stops being structured so that they can be travelled thereover;

said stop arrangement further includes a stop carrier seated upon the power take-off shaft; and said stop carrier having bores arranged at substantially uniform angular spacing from one another; and said bores being structured for receiving at least one stop plug forming said first stop.

2. The combat target as defined in claim 1, wherein:

there are provided a plurality of said stop plugs; and each of said stop plugs being constituted by a stop screw which can be threaded into a related bore of the stop carrier.

3. The combat target as defined in claim 1, wherein:

said bores extend essentially parallel to the power take-off shaft; and the stationary arranged stop extending radially with respect to said power take-off shaft.

4. The combat target as defined in claim 1, wherein:

said force storage means comprise a spring motor.

5. The combat target as defined in claim 1, wherein:

said power take-off shaft, in the presence of a hit at the target image, resiliently deflecting out of its upright position in order to temporarily place into its ineffectual position the stop arrangement.

6. The combat target as defined in claim 1, further including:

four stop plugs provided at said stop carrier and arranged at an angular spacing of about 90° from one another;

said target image having two target surfaces which are arranged essentially at right angles with respect to one another; and said target surfaces intersecting at a predetermined intersection line.

7. The combat target as defined in claim 6, wherein:

said predetermined intersection line essentially coincides with the power take-off shaft.

8. A combat target comprising:

means defining a target image;

a force storage means including a power take-off shaft;

said power take-off shaft being essentially erect when the target image is erect;

said target image being coupled for common rotation with said power take-off shaft;

the storage capacity of the force storage means being adopted for performing a number of revolutions of the power take-off shaft;

a stop arrangement against which said take-off shaft is resiliently biased; and said stop arrangement in the presence of a hit at the target image being temporarily placed into an ineffectual position for allowing the target image to perform a limited rotational movement;

said power take-off shaft, in the presence of a hit at the target image, resiliently deflecting out of its upright position in order to temporarily place into its ineffectual position the stop arrangement;

the power take-off shaft is mounted at a bearing bracket means;

spring means against which the bearing bracket means can be pivoted; and a pivot shaft extending transversely with respect to the power take-off shaft; and said power take-off shaft being mounted in said bearing bracket means to be pivotable about said transversely extending pivot shaft and against the action of said spring means.

9. The combat target as defined in claim 8, wherein:

said force storage means comprises a spring motor;

said spring motor including a gearing stage defined by a worm and a worm gear;

said worm gear being seated upon said power take-off shaft; and said bearing bracket means being pivotable about the lengthwise axis of said worm and at which there is mounted said power take-off shaft.

10. The combat target as defined in claim 9, wherein:

said stop arrangement includes a stop carrier seated upon the power take-off shaft;

said stop carrier having bores arranged at substantially uniform angular spacing from one another;

said bores being structured for receiving stop plugs;

said bores extending essentially parallel to the power take-off shaft;

a stationarily arranged stop extending radially with respect to the power take-off shaft; and said stationarily arranged stop being resiliently deflectable to a limited extent in the direction of revolution of the stop plugs.

* * * * *